United States Patent [19]

Green et al.

[11] 4,011,956

[45] Mar. 15, 1977

[54] CLOSURE MECHANISM FOR BOTTOM DUMP HOPPER CARS

[75] Inventors: Dan R. Green, Portage; Ernest J. Nagy, Munster, both of Ind.

[73] Assignee: Pullman Incorporated, Chicago, Ill.

[22] Filed: Aug. 15, 1975

[21] Appl. No.: 605,104

[52] U.S. Cl. ..... 214/63; 105/241 C

[51] Int. Cl.[2] ..... B61D 7/30

[58] Field of Search ..... 214/58, 63; 105/241 C

[56] References Cited

UNITED STATES PATENTS

| | | | |
|---|---|---|---|
| 3,251,487 | 5/1966 | Giesking | 214/63 |
| 3,585,938 | 6/1971 | Fisher et al. | 214/63 |
| 3,836,023 | 9/1974 | Peterson et al. | 214/63 |
| 3,891,101 | 6/1975 | Peterson | 214/63 |

*Primary Examiner*—Trygve M. Blix
*Assistant Examiner*—Charles E. Frankfort
*Attorney, Agent, or Firm*—Richard J. Myers

[57] ABSTRACT

A side of track closure mechanism is provided for engaging and exerting an inwardly directed lateral thrust against bottom dump doors of a hopper car for hingedly moving the doors inwardly to a closed position. The actuating mechanism includes a rotating arm having actuating apparatus at one end which when placed in an index position is adapted to engage the doors of bottom dump hopper cars as they move along a track adjacent to which the closure mechanism is positioned.

10 Claims, 5 Drawing Figures

FIG. 1
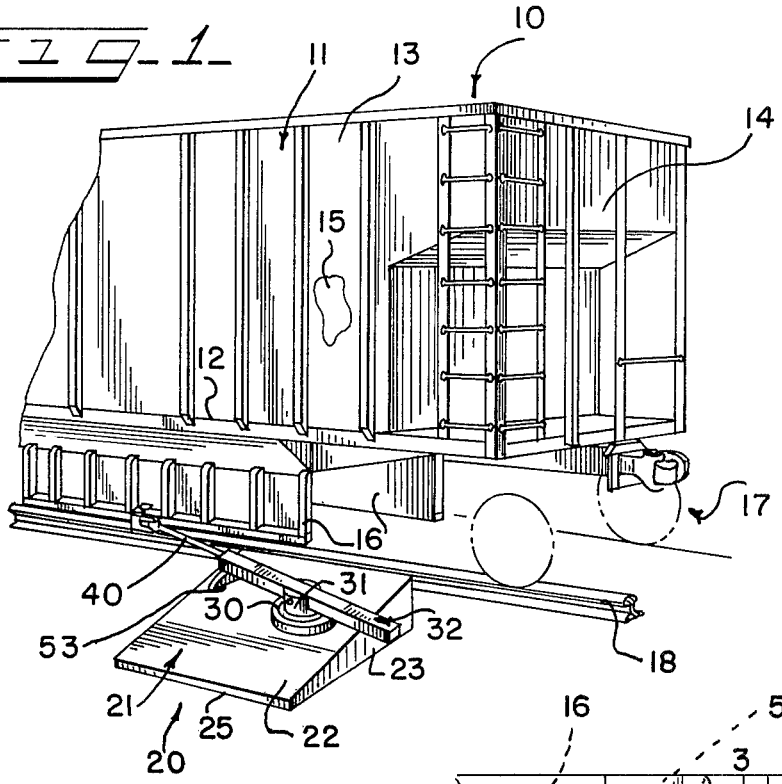
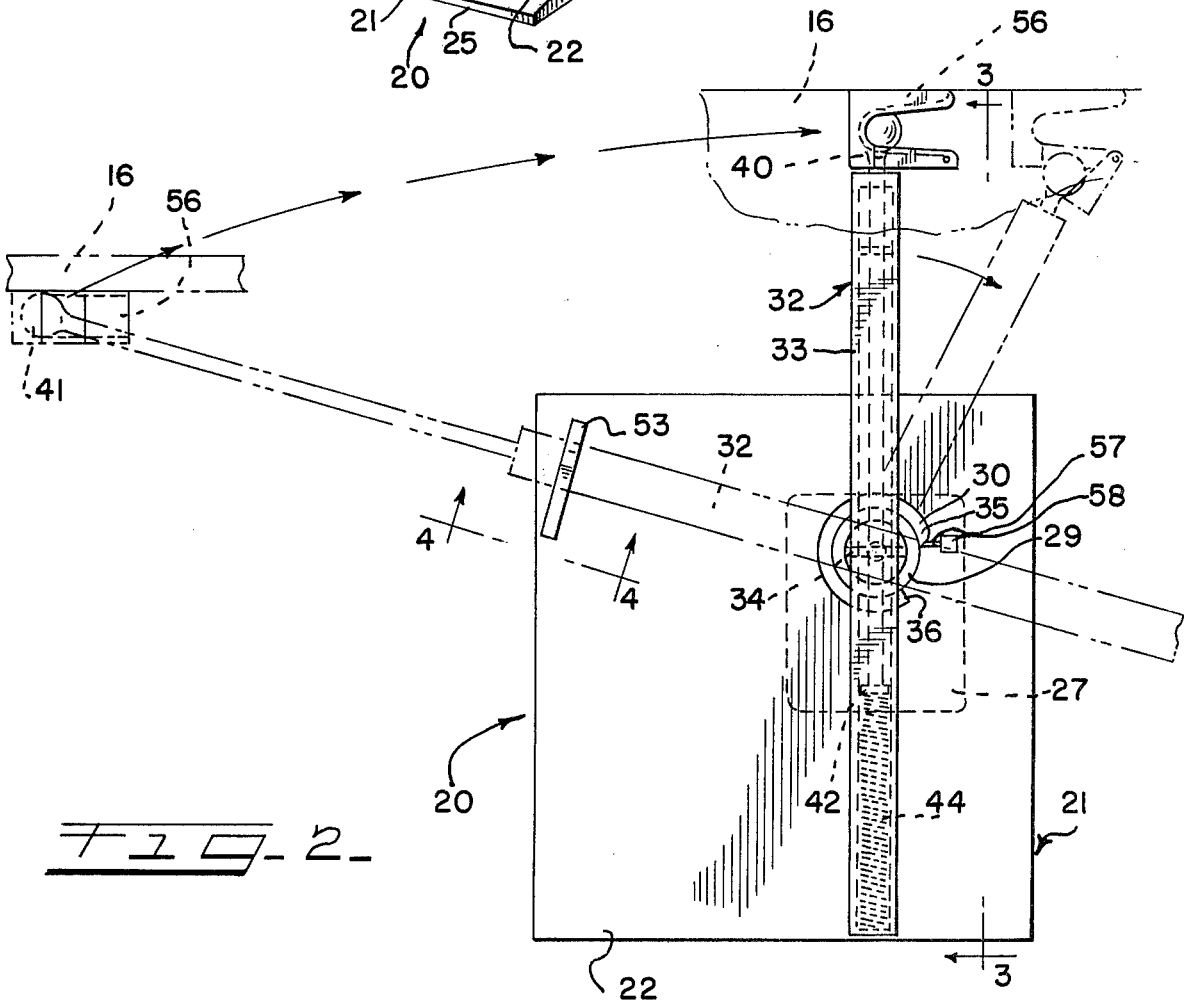
FIG. 2

CLOSURE MECHANISM FOR BOTTOM DUMP HOPPER CARS

BACKGROUND OF THE INVENTION

1. Field of the Invention

The present invention relates to railway hopper cars having downwardly swinging doors for dumping contents of the car downwardly through the track on which the car is positioned. More specifically, the invention is directed to a door closure mechanism which is positioned adjacent a track on which the cars move and which is actuatable to exert an inwardly directed thrust for closing the doors as the car is moved alongside the mechanism.

2. Description of the Prior Art

The prior art is most explicitly disclosed in U.S. Pat. Nos. 3,836,023, patented Sept. 17, 1974, and 3,891,101, patented June 24, 1975.

SUMMARY OF THE INVENTION

This invention is an improvement over assignee's patent aforementioned in the prior art and these are hereby incorporated by reference thereto.

The aforementioned and present inventions are concerned with improved mechanisms adjacent opposite sides of a railway track which close the downwardly swinging hopper doors of a bottom dump hopper car as the car is moved alongside the mechanism. The present invention is an improvement in that the rotating arm of each mechanism, is returned to an indexing position after the door is closed by means of an electric motor. This assures that the actuating arms are positively moved into the exact position desired for subsequent operation to again close the next set of hopper car doors as they appear adjacent to the mechanism. In the present arrangement the closure arm is of a tubular construction having contained therein a sliding piston rod and piston with the piston normally being urged by a spring to provide for extension of the piston rod outwardly of the tubular arm. As the actuating arm and piston, which contains the engaging member that engages the car door, arrives at an indexing position the piston rod is moved outwardly of the arm into an extended position ready to contact the door of a car which is moving along a track. Upon such contact engagement the piston rod and arm are then rotated, the door is closed, and the piston rod is moved into a retracted position wherein it is held by a latch mechanism. Immediately after the door is closed, the arm is then swung or rotated again to its indexing position. The arm now has been retracted and held in position by means of a latch against the biasing action of the spring. With the piston rod retracted the effective length of the arm and actuating member is, of course, greatly reduced so that a much shorter or smaller radial movement is required thereby using considerably less track area. This, of course, is a definite improvement over the aforementioned patents wherein the full length of the arms were maintained during the rotation of the mechanism.

BRIEF DESCRIPTION OF THE DRAWINGS

FIG. 1 is a perspective view of a portion of a railway hopper car supported on a track alongside a track side closure mechanism;

FIG. 2 is a plan view of a trackside hopper car closing mechanism schematically showing the closing operation for closing hopper car doors;

DESCRIPTION OF THE PREFERRED EMBODIMENT

Figure 3:
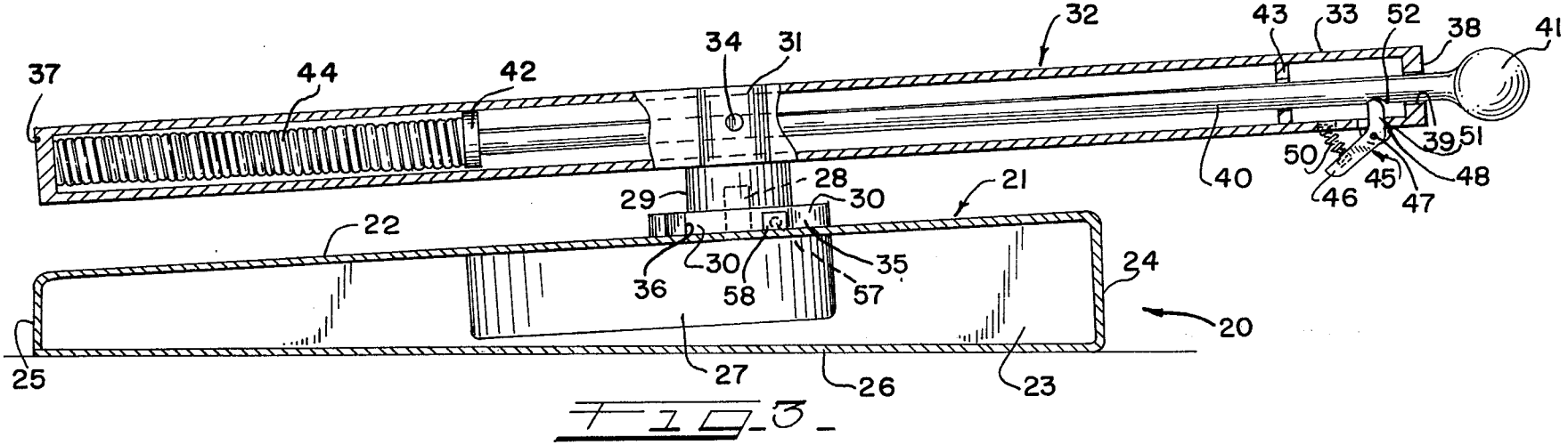
FIG. 3 is a cross-sectional view taken substantially along the line 3—3 of FIG. 2.

The aforementioned patents which are incorporated herein by reference disclose a hopper car and details thereof, a portion of which is also shown in FIG. 1. Referring now to FIG. 1, an open top hopper car 10 includes a body 11 having longitudinal side sills 12, side walls 13 and end bolster walls 14 (only one of which is shown). The hopper car 10 comprises a plurality of hoppers 15 which are closed and are provided at their lower ends with pairs of hinged bottom closure doors 16 adapted to open for dumping materials contained within the hopper downwardly through the track rails 18 into suitable pits provided at the destination point.

Door closure mechanisms 20 (only one of which is shown) as indicated in FIG. 1 are positioned on opposite sides of the track 18. Each mechanism 20 comprises a base or housing 21 of boxlike construction including a top wall 22, side walls 23 and front and rear walls 24 and 25 respectively. The bottom wall 26 encloses the housing and supports the mechanism 20 on the ground adjacent to the track 18. The housing 21 has contained therein an electrically actuated motor 27 provided with a conventional motor shaft 28 projecting vertically upwardly. The shaft 28 is suitably connected to a rotor or rotating member 29 which is provided at its base with a cam 30. The rotor or rotating member 29 also is provided with an upwardly projecting yoke 31 which supports a closing arm generally designed at 32. The closing arm 32 comprises a tubular member 33 of generally rectangular construction being closed at opposite ends by an end wall 37 and a front wall 38. The front wall 38 is provided with an aperture or bore 39. An actuating member or piston rod 40 is provided at its forward end with an engaging member or ball 41. The other end of the piston rod 40 is provided with a piston 42 which is adapted to move with the rod 40 in sliding telescoping relation with respect to the tubular member 33. A pair of stops 43 are positioned at the forward end of the tubular member 33 spaced from the front wall 38. As best shown in FIG. 3, a spring 44 is held captive by the end wall 37 and the piston 42 and continually biases or urges the rod 40 to an extended position.

Figure 4:
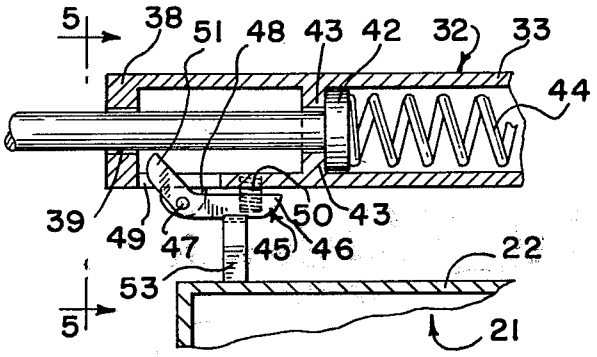
FIG. 4 is a cross-sectional view taken substantially along the line 4—4 of FIG. 2.

As best shown in FIGS. 3 and 4, a latch 45 is adapted to engage the piston rod 40 for maintaining the same in a retracted position as shown in FIG. 3. The latch 45 comprises a keeper 46 pivotally supported as indicated at 47 by means of a bracket 48. The keeper 46 includes a finger 51 which is adapted to operate through a slot 49 provided in the bottom wall of the tubular member 33. A spring 50 suitably anchored on the tubular member 40 urges the finger 51 continually into engagement with a pocket or recess 52 (as shown in FIG. 3) provided in the piston rod 40. The pocket 52 thus acts as a stop and upon engagement by the finger 51 locks the piston rod 40 in the retract position against the biasing action of the spring 44.

Figure 5:
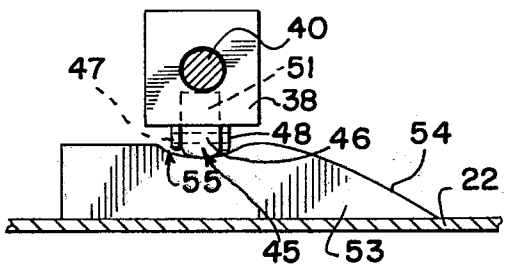
FIG. 5 is a cross-sectional view taken substantially along the line 5—5 of FIG. 4.

As unlocking cam is best disclosed in FIGS. 4 and 5 the same being designated at 53 and being suitably supported on the top wall 22 of the housing 21. The cam 53 acts to support the arm 32 at an indexing point or position wherein it is ready to engage a car door for closing the same in the manner disclosed in the aforementioned patents. The cam 53 also includes an arcuate cam surface 54 along which the keeper 46 moves for disengaging the latch 45 from the closed position shown in FIG. 3. The cam 53 also includes a recess 55 adapted to cradle the keeper 46 with the arm 32 in its indexing position ready to engage and close the door of a hopper car as it is moving along the track. The engaging member or ball 41, as shown in FIG. 2 is adapted to engage a slotted engaging bracket 56 and to be released therefrom when the door has been closed, the same being more specifically described in the aforementioned U.S. Pat. No. 3,891,101.

The cam 30 which is connected to the rotor 29, as best shown in FIG. 2, includes a cam face portion 35. The cam 30 extends only partially around the rotor and has an end portion 36 which is spaced from the cam face 35. The cam face 35 is adapted to engage and trip the plunger 57 of a microswitch 58 suitably connected to a conventional electrical circuit (not shown) to provide for energizing of the electric motor 27.

THE OPERATION

Referring now particularly to FIG. 2 the broken lines show the actuating arm 32 in an indexing position. In this position the actuating arm is adapted to engage the door 16 to move the same into the closed position. As the door is moving along with the car the arm 32 is rotated in an arc to the full line position shown in FIG. 2 the piston rod 40 now having been moved to its retracted position whereupon the arm is disengaged from the door bracket 56 as the car continues along its way with the doors closed. At this point the cam face 35 and cam end 36 are in the full line position shown in FIG. 2. The cam face 35 now engages the plunger 57 to actuate the microswitch 58 which energizes the motor 27 to continue rotation of the arm 32 in a clockwise manner as shown in FIG. 2. The latch 45 has engaged the piston rod 40 to maintain the same in its retracted position. It is thus clear that the rotating movement of the arm is at a greatly reduced length radius, which is particularly desired in order to conserve trackside space which in many instances is substantially narrow between a series of railway tracks running along in parallel spaced relation. Thus when the rotating arm 32 is again moved to its indexing position the piston rod is retracted until the keeper 46 slides upwardly on the arcuate cam surface 54 of the unlocking cam 53. Referring now to FIG. 4, it is seen that the keeper 46 is pivoted to compress the spring 50 whereupon the finger 51 is rotated to the out-of-the-way position shown in FIG. 4, from the pocket 52 of the rod 40, so that the rod 40 now is moved by the spring 44 to the extended position for engaging the swinging door of a succeeding car.

The present arrangement thus is particularly improved over the prior art in that the telescoping arrangement of the arm and piston permits the mechanism to be utilized wherein there is a relatively small distance between and alongside the tracks adjacent a pit to which the material is to be dumped from the hopper cars. Also the mechanism includes a positive electrical motor means for assuring positive rotation of the operating arm again to its indexing position ready for engagement with a succeeding car door.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention.

What is claimed is:

1. For a hopper car having a hopper positioned between a pair of side sills, door means supported on said car for hinging movement on longitudinal axis parallel to said sills from an open substantially vertical position to a closed substantially horizontal position beneath said hopper, the improvement comprising:

a door means closing mechanism including a support stationarily positioned to one side of a track on which said car is positioned, a closing arm including means supporting said arm for rotating movement about a vertical axis on said support whereby said arm is movable in a generally arcuate path around said axis, actuating means movably connected to said arm to extend and retract lengthwise relative to said arm during pivotal movement thereof, engageable means on said door means, indexing means engaging and positioning said actuating means whereby the same is in an initial actuating position to engage said engageable means on said door means when said car is moved on said track alongside said support thereby rotating said arm to provide a lateral force moving said door means inwardly to a closed position, and motor means connected to said arm for rotating said arm and actuating means again into engaging position with said indexing means.

2. The invention in accordance with claim 1, said motor means comprising an electrical motor, and electrical switching means responsive to the position of said arm for actuating said motor.

3. The invention in accordance with claim 2, said switching means comprising a switch having cam engageable actuating means, and a cam rotatably associated with said arm for engaging said switch to trip the same for energizing said motor at a predetermined point of rotation of said arm following said closing movement of said door.

4. The invention in accordance with claim 1, said actuating means comprising a member supported on said arm for relative telescoping movement with respect thereto.

5. The invention in accordance with claim 4, said arm having a tubular configuration, said member of said actuating means comprising a rod having a piston slideably supported within said tubular arm, and means within said arm biasing said piston and rod to an extended position.

6. The invention in accordance with claim 5, said biasing means comprising a spring held captive within said tubular arm and having one end thereof in engagement with said piston.

7. The invention in accordance with claim 6, said actuating means further comprising latch means for locking said rod and piston in a retracted position, and means for releasing said latch means to unlock said rod and piston when said actuating means is in engaging position with respect to said indexing means.

8. The invention in accordance with claim 7, said latch means including a pivoted keeper member supported on said arm, and means biasing said keeper member into a locking position engaging said rod.

9. The invention in accordance withclaim 8, said means on said indexing means including a cam member.

10. The invention in accordance with claim 7, said rod and piston again being moved to said retracted and locked position during movement of said door means inwardly to said closed position.

* * * * *